US006802293B2

(12) United States Patent
Iwata et al.

(10) Patent No.: US 6,802,293 B2
(45) Date of Patent: Oct. 12, 2004

(54) INTAKE MANIFOLDS

(75) Inventors: Shinji Iwata, Aichi-ken (JP); Hironori Tanikawa, Aichi-ken (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 10/383,749

(22) Filed: Mar. 10, 2003

(65) Prior Publication Data

US 2003/0172894 A1 Sep. 18, 2003

(30) Foreign Application Priority Data

Mar. 12, 2002 (JP) ..... 2002-067287

(51) Int. Cl.[7] ..... F02M 35/10

(52) U.S. Cl. ..... 123/184.42; 277/594; 285/148.13; 123/184.61

(58) Field of Search ..... 123/184.42, 184.61; 277/594, 595, 596; 285/148.13, 238

(56) References Cited

U.S. PATENT DOCUMENTS 4,446,823 A * 5/1984 Bessho ..... 123/184.42
4,932,369 A * 6/1990 Parr ..... 123/184.42

* cited by examiner

*Primary Examiner*—Andrew M. Dolinar
*Assistant Examiner*—Katrina B. Harris
(74) *Attorney, Agent, or Firm*—Dennison, Schultz, Dougherty & MacDonald

(57) ABSTRACT

An intake manifold includes a manifold body and a joint. The joint is made of metal and includes an upstream-side portion and a downstream-side portion that are joined to each other. The upstream-side portion is joined to a manifold body on the upstream-side of the manifold body. The downstream-side portion is joined to the manifold on the downstream-side of the manifold.

15 Claims, 5 Drawing Sheets

INTAKE MANIFOLDS

This application claims priority to Japanese patent application serial number 2002-067287, the contents of which are incorporated herein by reference.

TECHNICAL FIELD

The present invention relates to intake manifolds that are connected to engines, e.g. internal combustion engines, in order to supply an intake air to the engines.

DESCRIPTION OF THE RELATED ART

Intake manifolds are known that are made of resin and have surge tanks that are disposed on the upstream side. Throttle bodies are joined to the surge tanks. The downstream side of the intake manifolds is joined to engines, e.g., internal combustion engines. Because the rigidity of such intake manifolds made of resin is not sufficient to ensure the reduction of vibrations of the throttle bodies, the throttle bodies are supported by the engines via brackets. Japanese Laid-Open Patent Publication No. 10-107867 teaches such a known intake manifold made of resin.

However, even if the throttle body is supported by the engine, it is not possible to effectively reduce vibrations of the throttle body by the support of bracket.

SUMMARY OF THE INVENTION

It is accordingly an object of the present invention to teach improved techniques for effectively reducing vibrations of an upstream-side member, e.g., a throttle body, that is joined to an intake manifold.

According to one aspect of the present teachings, intake manifolds are taught that have a joint made of metal, e.g., aluminum, magnesium and stainless steel. The joint may include an upstream-side portion and a downstream-side portion that are joined to each other. The upstream-side portion may be joined to a manifold body on the upstream-side of the manifold body. The downstream-side portion may be joined to the manifold on the downstream-side of the manifold.

Because the manifold body is joined to the metal joint on both upstream and downstream sides, the rigidity of the entire intake manifold may be improved even in case that the manifold body is made of resin or similar material that has a relatively low rigidity.

An upstream-side end of the upstream-side portion of the joint may be joined to an upstream-side member, e.g. a throttle body. A downstream-side end of the downstream-side portion of the joint may be joined to a rigid fixed member, e.g. a cylinder head of an internal combustion engine.

Therefore, vibrations of the upstream-side member may be reliably reduced due to the rigid support of the intake manifold.

According to another aspect of the present teachings, the upstream-side portion and the downstream portion of the joint may be formed integrally with each other. Therefore, the rigidity of the intake manifold may be further improved.

According to another aspect of the present teachings, the joint may be joined to the manifold body via flanges and fasteners, e.g., bolts.

According to another aspect of the present teachings, the joint may be joined to the manifold body via tubular extensions that are fitted with each other. Therefore, the operation for joining the joint to the manifold body can be facilitated.

BRIEF DESCRIPTION OF THE DRAWINGS

Additional objects, features and advantages of the present invention will be readily understood after reading the following detailed description together with the claims and the accompanying drawings, in which:

DETAILED DESCRIPTION OF THE INVENTION

Figure 1:
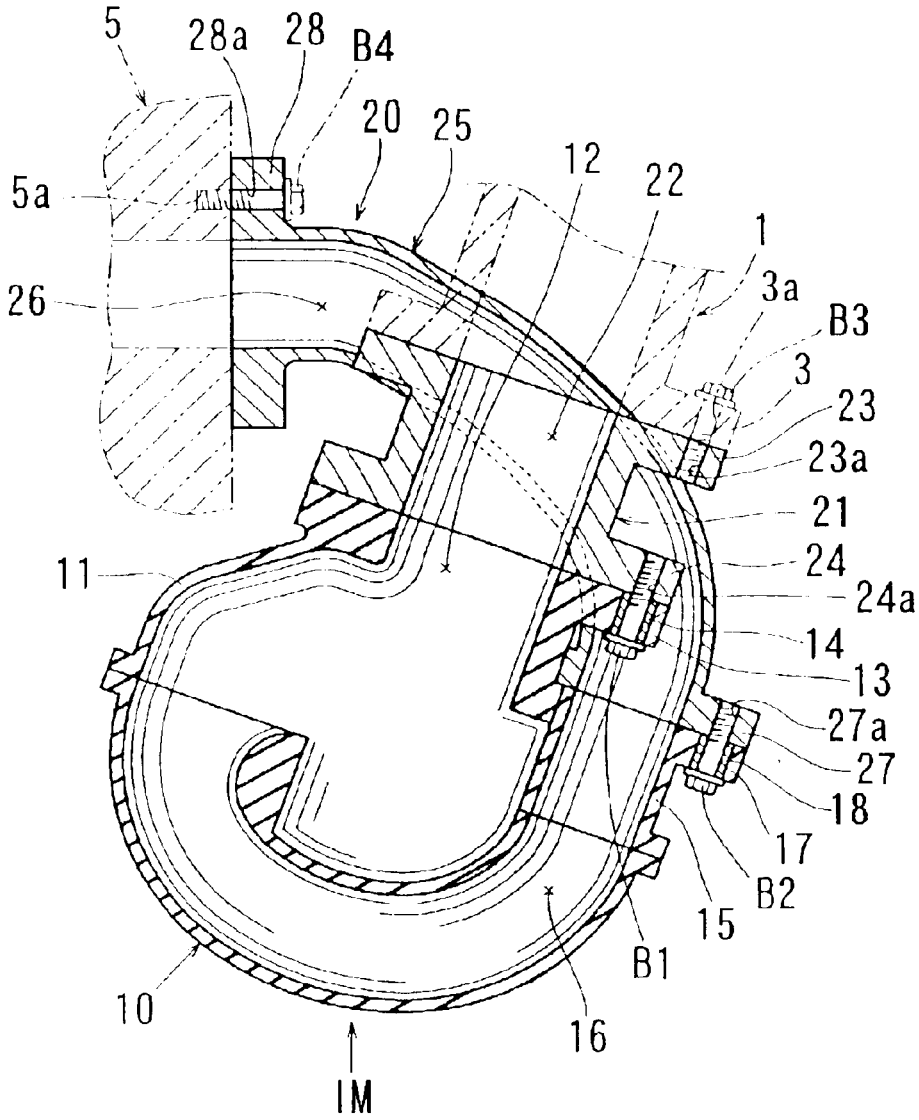
FIG. 1 is a sectional view of a first representative intake manifold.

In one embodiment of the present teachings, intake manifolds may include a manifold body and a joint. The manifold body may be made of resin (plastic), e.g., nylon. The joint may be made of metal, e.g., aluminum, magnesium and stainless steel. The joint may include an upstream-side portion and a downstream-side portion. The upstream-side portion and the downstream-side portion may be joined to each other and also may be joined to the manifold body on an upstream-side and a downstream side of the manifold body, respectively.

An upstream-side end of the upstream-side portion of the joint may be joined to a throttle body. A downstream-side end of the downstream-side portion of the joint may be joined to a cylinder head of an engine, e.g., an internal combustion engine.

Therefore, although the manifold body may have a relatively low rigidity, the entire intake manifold may have a relatively high rigidity. As a result, the throttle body may be firmly supported on the cylinder head via the intake manifold. As a result, vibrations of the throttle body may be effectively reduced.

In another embodiment of the present teachings, the upstream-side portion and the downstream-side portion of the joint may be detachably joined to the manifold body.

In another embodiment of the present teachings, the upstream-side portion and the downstream-side portion of the joint may be formed integrally with each other.

In another embodiment of the present teachings, the manifold body may include a surge tank portion and a branch tube portion that are joined to the upstream-side portion and the downstream-side portion of the joint, respectively. Preferably, the surge tank portion and the branch tube portion may be formed integrally with each other.

In another embodiment of the present teachings, the manifold body may have an upstream-side end and a downstream-side end that include a first resin flange and a second resin flange formed integrally with the manifold body, respectively. The upstream-side portion of the joint may have a first metal flange. The first metal joint may be formed integrally with the joint and may be joined to the first resin flange. The downstream-side portion of the joint may have a second metal flange. The second metal flange may be formed integrally with the joint and may be joined to the second resin flange.

In another embodiment of the present teachings, the first resin flange and the first metal flange may be joined to each other via a first fastener, e.g. a bolt(s). The second resin flange and the second metal flange may be joined to each other via a second fastener, e.g., a bolt(s).

In another embodiment of the present teachings, the upstream side portion of the joint may be joined to the manifold body via tubular extensions that are fitted with each other.

Each of the additional features and teachings disclosed above and below may be utilized separately or in conjunction with other features and teachings to provide improved intake manifolds and using such intake manifolds. Representative examples of the present invention, which examples utilize many of these additional features and teachings both separately and in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

A first representative intake manifold will now be described with reference to FIGS. 1 to 3.

Figure 2:
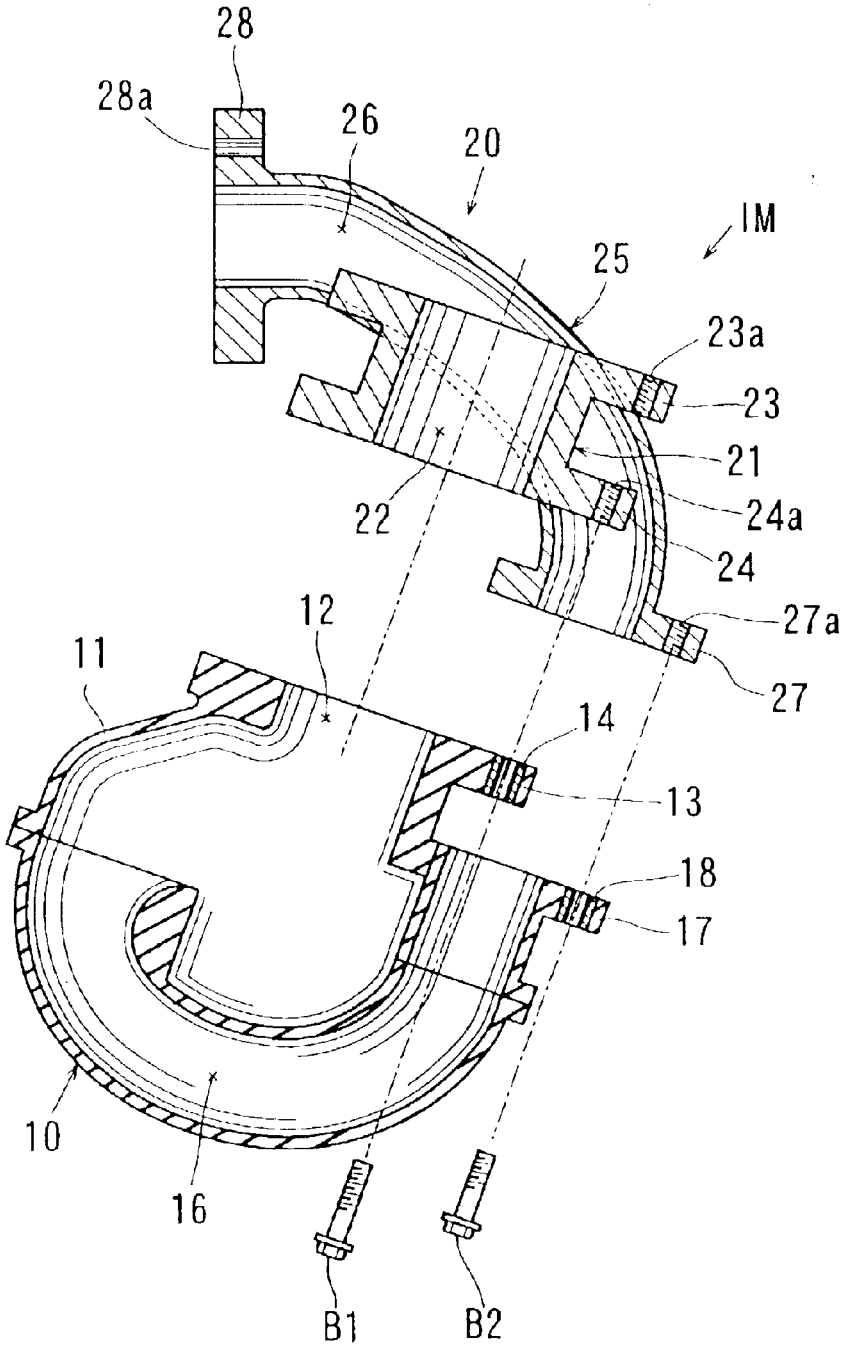
FIG. 2 is an exploded sectional view of the first representative intake manifold.

Referring to FIGS. 1 and 2, a representative intake manifold IM may generally comprise a manifold body 10 and a joint 20. The manifold body 10 may preferably be made of resin (plastic), e.g., nylon, and may constitute a primary element of the intake manifold IM. The manifold body 10 may include a surge tank portion 11 and a branch tube portion 15. An inlet 12 for an intake air may be defined in an upstream-side end of the surge tank portion 11. A flange 13 may be formed on the upstream-side end of the surge tank portion 11 and may extend outward in a radial direction. The flange 12 also may be made of resin (plastic) and will be hereinafter also called "first resin flange 12." A tubular sleeve 14 (hereinafter also called "first sleeve 14") may be fitted into the first resin flange 13 in a predetermined position.

The branch tube portion 15 may be connected to an engine 5 (e.g., an internal combustion engine), in particular, to a cylinder head of the engine 5. Preferably, the cylinder head may be made of metal, e.g., iron and aluminum alloy. The branch tube portion 15 may provide a guide for flow of the intake air from the surge tank portion 11 to cylinders (not shown) of the engine 5. The branch tube portion 15 may define plural pairs of branch channels 16. Each pair of the branch channels 16 may communicate with corresponding one of the cylinders. Therefore, if the engine 5 has four cylinders, four pairs of the branch channels 16 may be formed in the branch tube portion 15 as shown in FIG. 3.

Referring to FIG. 1, a flange 17 (hereinafter also called "second resin flange 17") may be formed on a downstream-side end of the branch tube portion 15 and may extend outward in a diametrical direction. A tubular sleeve 18 (hereinafter also called "second sleeve 18") may be fitted into the second resin flange 17 in a predetermined position (see. FIG. 2).

Preferably, the manifold body 10 may be made of various parts that are molded separately by utilizing a known resin molding technique, e.g., an injection molding process and a blow molding process. These parts may be joined together, e.g., by means of a vibration welding technique, to form the manifold body 10 that is a one-piece member.

Referring to FIG. 2, the joint 20 may preferably be made of metal, e.g. aluminum, magnesium and stainless steel. The joint 20 may have an upstream-side portion 21 and a downstream-side portion 25 that are formed integrally with each other. Alternatively, the upstream-side portion 21 and the downstream-side portion 25 may be formed separately from each other and may be joined to each other by suitable fasteners, e.g. bolts and nuts.

Figure 3:
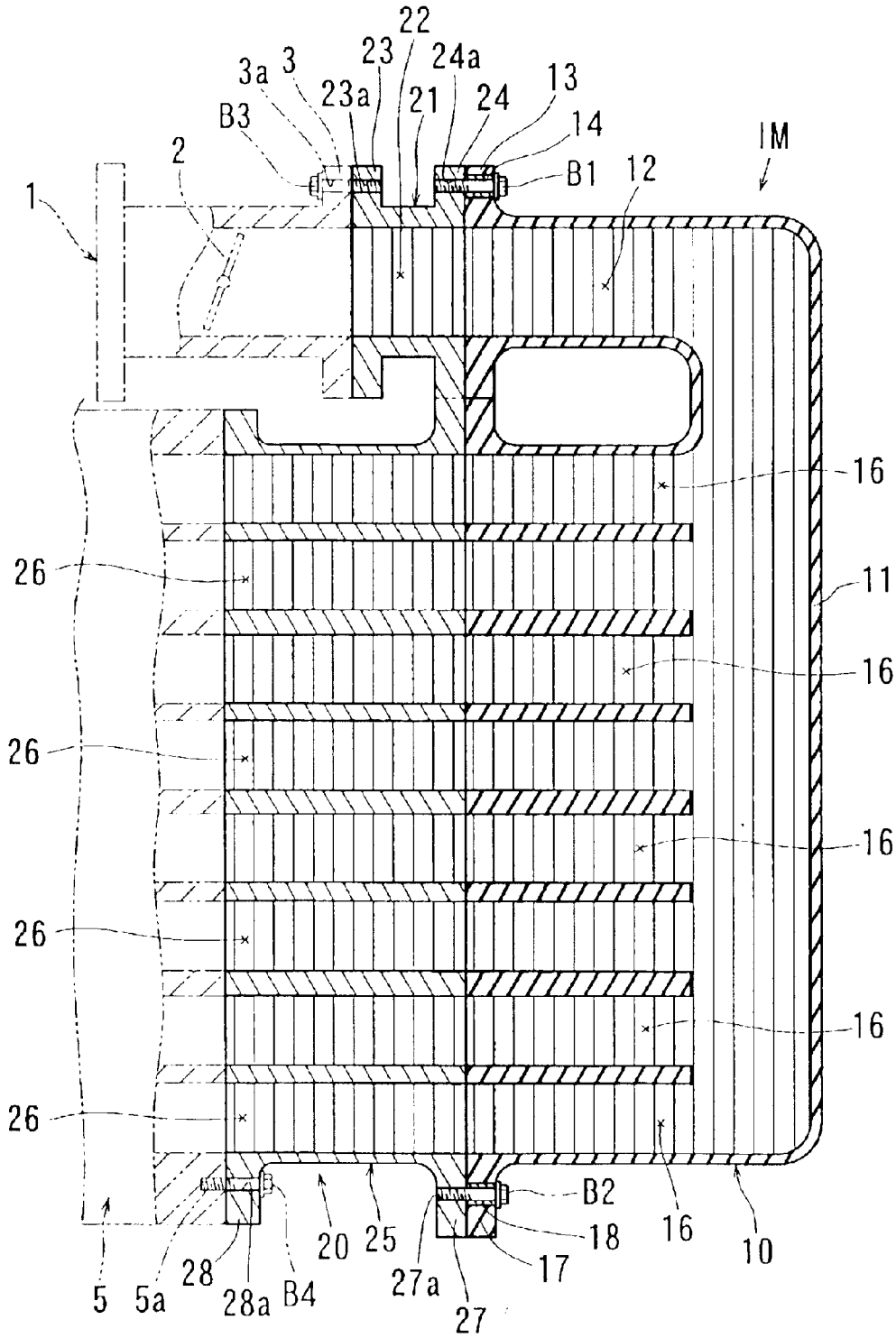
FIG. 3 is an explanatory sectional view showing a flow path of an intake air within the intake manifold.

Referring to FIGS. 1 and 3, the upstream-side portion 21 may define an upstream-side channel 22 that communicates with the inlet 12 of the surge tank portion 11 of the manifold body 10.

Referring to FIG. 2, a flange 23 (hereinafter also called "first metal flange 23") may be formed on an upstream-side end of the upstream-side portion 21 and may extend outward in a radial direction. A fist threaded hole 23*a* may be formed in the first metal flange 23 in a predetermined position.

A flange 24 (hereinafter also called "second metal flange 24") may be formed on a downstream-side end of the upstream-side portion 21 and may extend outward in a radial direction. A second threaded hole 24*a* may be formed in the second metal flange 24 in a predetermined position.

As shown in FIGS. 1 and 3, the downstream-side portion 25 may define a downstream-side channel 26 that communicates with the branch channel 16 of the branch tube portion 15 of the manifold body 10.

Referring to FIG. 2, a flange 27 (hereinafter also called "third metal flange 27") may be formed on an upstream-side end of the downstream-side portion 25 and may extend outward in a radial direction. A third threaded hole 27*a* may be formed in, the third metal flange 27 in a predetermined position.

A flange 28 (hereinafter also called "fourth metal flange 28") may be formed on a downstream-side end of the downstream side portion 25. An insertion hole 28*a* may be formed in the fourth metal flange 28 in a predetermined position.

As shown in FIGS. 1 and 3, the manifold body 10 and the joint 20 may be joined together by means of bolts B1 and B2.

Thus, the bolt B1 may be inserted into the sleeve 14 of the first resin flange 13 that is formed on the surge tank portion 11 of the manifold body 10. The bolt B1 may then be engaged with the threaded hole 24*a* formed in the second metal flange 24 that is formed on the upstream-side portion 21 of the joint 20. Therefore, the first resin flange 13 and the second metal flange 24 may be joined to each other by tightening the bolt B1.

On the other hand, the bolt B2 may be inserted into the sleeve 18 of the second resin flange 17 that is formed on the branch tube portion 15 of the manifold body 10. The bolt B2 may then be engaged with the threaded hole 27*a* formed in the third metal flange 27 that is formed on the downstream-side portion 25 of the joint 20. Therefore, the second resin flange 17 and the third metal flange 27 may be joined to each other by tightening the bolt B2.

Referring to FIG. 3, a throttle body 1 may be disposed on the upstream-side of the intake manifold IM. A throttle valve 2 may be disposed within the throttle body 1. The throttle body 1 may be made of metal, e.g., aluminum alloy, or may be made of resin, e.g. nylon.

The throttle body 1 may be joined to the intake manifold IM by means of a bolt B3. Thus, the bolt B3 may be inserted into an insertion hole 3*a* that is defined in a flange 3 formed on the throttle body 1. The bolt B3 may then be engaged with the threaded hole 23*a* of the first metal flange 23 that is formed on the upstream-side portion 21 of the joint 20. Therefore, the flange 3 and the first metal flange 23 may be joined to each other by tightening the bolt B3.

Preferably, an air cleaner (not shown) may be disposed on the upstream side of the throttle body 1 and may serve to remove dusts that may be contained in the intake air.

The downstream-side end of the intake manifold IM may be joined to the engine 5, in particular to the cylinder head of the engine 5, by means of a bolt B4 as shown in FIGS. 1 and 3. Thus, the bolt B4 may be inserted into the insertion hole 28*a* formed in the fourth metal flange 28. The fourth metal flange 28 may be formed on the downstream-side portion 25 of the joint 20. The bolt B4 may then be engaged with a threaded hole 5a formed in the engine 5, so that the fourth metal flange 28 may be joined to the engine 5 by tightening the bolt B4. .

In operation, the air may enter the throttle body 1 via the air cleaner (not shown). The air may then flow into the surge tank portion 11 of the manifold body 10 of the intake manifold IM via the upstream-side channel 22 that is defined in the upstream-side portion 21 of the joint 20. The intake air may then flow from the surge tank portion 11 into the pairs of the branch channels 16 of the branch tube portion 15 of the manifold body 10. The air distributed into each pair of the branch channels 16 may then enter the corresponding cylinder of the engine 5 via the downstream-side channel 26 that is defined within the downstream-side portion 25 of the joint 20.

The flow rate of the intake air that is supplied to each cylinder of the engine 5 may be adjusted by varying the degree of opening of the throttle valve 2 disposed within the throttle body 1 (see FIG. 3). Although not shown in the drawings, fuel injectors may be mounted within the engine 5 in order to inject a fuel (e.g., gasoline). Therefore, the intake air supplied from the intake manifold IM may be mixed with the fuel that is injected by the injectors and then may be supplied into the cylinders.

The first representative intake manifold IM is configured such that the downstream-side portion 25 of the joint 20 may be joined to the engine 5. Therefore, the throttle body 1 may be reliably supported by the upstream-side portion 21 that is formed integrally with the downstream-side portion 25. As a result, vibrations of the throttle body 1 can be effectively reduced or minimized, while the manifold body 10 made of resin is incorporated as a primary element of the intake manifold IM.

In addition, because the vibrations of the throttle body 1 can be reduced, unfavorable noises due to such vibrations may be reduced. In particular, if the engine 5 is a vehicle engine, transmission of noises from the engine into a vehicle cabin can be reduced. Furthermore, the representative intake manifold IM is advantageous, because a bracket as required in the known support mechanism is no longer necessary.

A second representative intake manifold will now be described with reference to FIGS. 4 and 5. The second representative intake manifold is a modification of the first representative intake manifold. Therefore, like members are given the same reference numerals as the first representative intake manifold and an explanation of these members will not be necessary.

Figure 4:
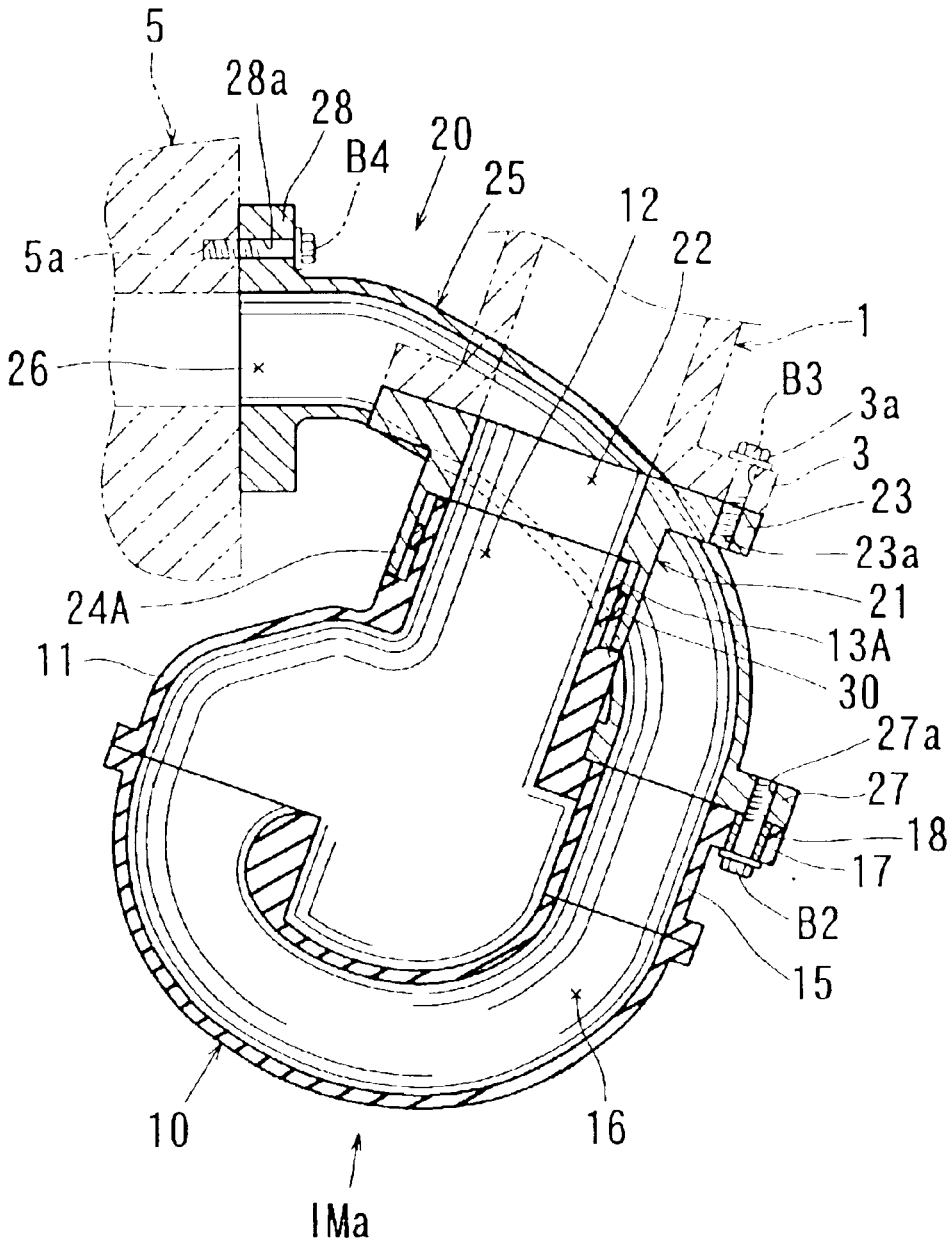
FIG. 4 is a sectional view of a second representative intake manifold.
Figure 5:
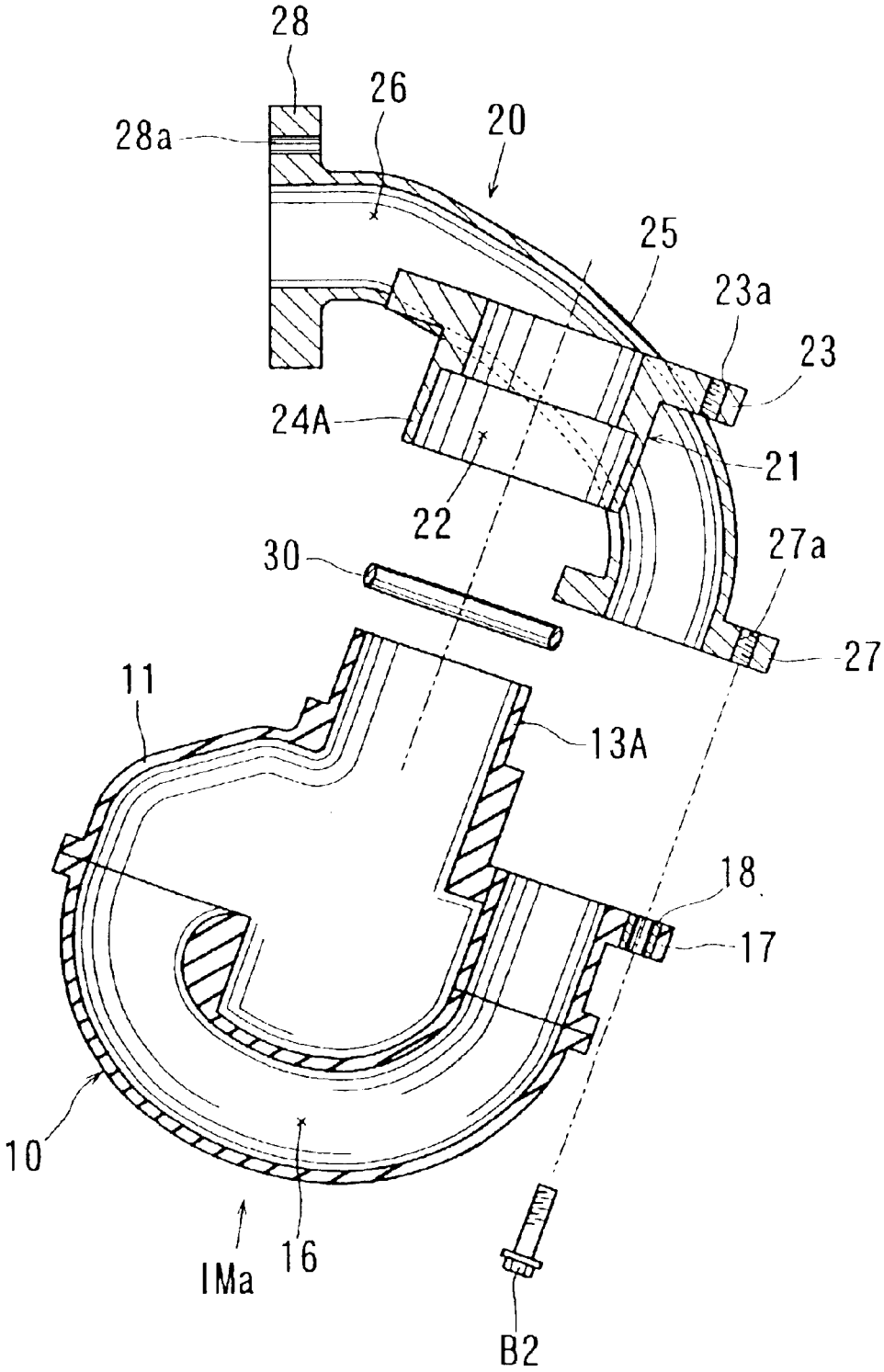
FIG. 5 is an exploded sectional view of the second representative intake manifold.

Referring to FIGS. 4 and 5, a second representative intake manifold IMa may be different from the first representative intake manifold IM in the joint structure between the surge tank portion 11 of the manifold body 10 and the upstream-side portion 21 of the joint 20.

Thus, as shown in FIG. 5, the upstream-side end of the surge tank portion 11 of the manifold body 10 may have a small tubular extension 13A in place of the first resin flange 13 (see FIG. 1) of the first representative intake manifold IM. The small tubular extension 13A may have an outer diameter that is smaller than the outer diameter of the remaining part of the upstream-side end of the surge tank portion 11.

On the other hand, the upstream-side portion 21 of the joint 20 may have a large tubular extension 24A in place of the second metal flange 24 (see FIG. 1) of the first representative intake manifold IM. The large tubular extension 24A may have an inner diameter that is greater than or substantially equal to the outer diameter of the small tubular extension 13A.

The small tubular extension 13A of the manifold body 10 may be fitted into the large tubular extension 24A, so that the inlet 12 for the intake air and the upstream-side channel 22 of the upstream-side portion 21 of the joint 20 communicate with each other.

Preferably, a seal member 30 may be interposed between the small tubular extension 13A of the manifold body 10 and the large tubular extension 24A of the joint 20 so as to provide air tight between the small tubular extension 13A and the large tubular extension 24A (see FIG. 4). Preferably, the seal member 30 may be a ring that is made of resilient or elastic material.

The second representative intake manifold IMa may provide substantially the same operation and advantages as the first representative intake manifold IM.

In addition, the second representative intake manifold IMa is advantageous, because the upstream-side portion 21 of the joint 20 can be easily joined to the manifold body 10 by the fitting operation (see FIG. 4). Further, the number of steps for assembling the intake manifold can be reduced, because a bolt such as the bold B1 of the first representative intake manifold IM is no longer necessary.

The above representative embodiments may be modified in various ways. For example, the bolts B1 and B2 for joining the joint 20 to the manifold body 10 may be replaced with any other connectors or fasteners, e.g., clamp devices. In addition, any other device than the throttle body 1 may be joined to the upstream-side portion of the intake manifold IM (IMa). Further, the engine 5 may be joined to the downstream side portion of the intake manifold IM (IMa) via a swirl control valve.

What is claimed is:

1. An intake manifold comprising:

a manifold body made of resin; and a joint made of metal and including an upstream-side portion and a downstream-side portion, wherein:

the upstream-side portion and the downstream-side portion are joined to each other and are arranged and constructed to be joined to the manifold body on an upstream-side and a downstream side of the manifold body, respectively;

the upstream-side portion is arranged and constructed to be joined to a throttle body;

the manifold body comprises a surge tank portion and a branch tube portion that are arranged and constructed to be joined to the upstream-side portion and the downstream-side portion of the joint, respectively;

the upstream-side portion of the joint is disposed on the lateral side of the downstream-side portion; and, the downstream-side portion is connected between the branch tube portion and an engine.

2. An intake manifold as in claim 1, wherein the upstream-side portion and the downstream-side portion of the joint are detachably joined to the manifold body.

3. An intake manifold as in claim 1, wherein the upstream-side portion and the downstream-side portion of the joint are formed integrally with each other.

4. An intake manifold as in claim 1, wherein the downstream-side portion is arranged and constructed to be joined to an engine on the side opposite to the manifold body.

5. An intake manifold as in claim 1, wherein:

the manifold body has an upstream-side end and a downstream-side end that include a first resin flange and a second resin flange formed integrally with the manifold body, respectively, the upstream-side portion of the joint has a first metal flange that is formed integrally with the joint and is arranged and constructed to be joined to the first resin flange, and the downstream-side portion of the joint has a second metal flange that is formed integrally with the joint and arranged and constructed to be joined to the second resin flange.

6. An intake manifold as in claim 5, further including a first fastener and a second fastener, wherein the first fastener is arranged and constructed to fix the first resin flange and the first metal flange to each other, and the second fastener is arranged and constructed to fix the second resin flange and the second metal flange to each other.

7. An intake manifold as in claim 6, wherein the first fastener and the second fastener comprise bolts.

8. An intake manifold as in claim 1, wherein:

the manifold body has an upstream-side end and a downstream-side end, the upstream-side end includes a tubular resin extension, the upstream side portion of the joint has a tubular metal extension, and the resin extension and the metal extension are arranged and constructed to be fitted with each other.

9. An intake manifold as in claim 8, further including a seal member interposed between the resin extension and the metal extension.

10. An intake manifold as in claim 8, wherein:

the downstream-side end of the manifold body has a resin flange, the downstream-side portion of the joint has a metal flange that is arranged and constructed to be joined to the resin flange.

11. An intake manifold as in claim 1, wherein the upstream-side portion and the downstream-side portion of the joint comprise an upstream-side channel and a downstream-side channel, respectively, and wherein the throttle body has an axis that extends along substantially the same axis as the upstream-side channel, and wherein the throttle body is positioned adjacent to and along a lateral side of the downstream-side portion of the joint.

12. An intake manifold as in claim 1, wherein the upstream-side portion and the downstream-side portion of the joint comprise an upstream-side channel and a downstream-side channel respectively, that extend substantially parallel to each other and are connected to the manifold body on the same side with each other.

13. An intake manifold comprising:

a manifold body made of resin; and a joint made of metal and including an upstream-side portion and a downstream-side portion, wherein:

the upstream-side portion and the downstream-side portion are joined to each other and are arranged and constructed to be joined to the manifold body on an upstream-side and a downstream side of the manifold body, respectively, the manifold body has an upstream-side end and a downstream-side end, the upstream-side end includes a tubular resin extension, the upstream side portion of the joint has a tubular metal extension, and the resin extension and the metal extension are arranged and constructed to be fitted with each other.

14. An intake manifold as in claim 13, further including a seal member interposed between the resin extension and the metal extension.

15. An intake manifold as in claim 13, wherein:

the downstream-side end of the manifold body has a resin flange, the downstream-side portion of the joint has a metal flange that is arranged and constructed to be joined to the resin flange.

* * * * *